United States Patent [19]

Overall

[11] 4,273,255

[45] Jun. 16, 1981

[54] NEWSPAPER DISPENSER

[76] Inventor: Kenneth D. Overall, 328 Paragon Mills Rd., Nashville, Tenn. 37211

[21] Appl. No.: 97,177

[22] Filed: Nov. 26, 1979

[51] Int. Cl.[3] ..... B65H 3/22

[52] U.S. Cl. ..... 221/213; 221/227

[58] Field of Search ..... 221/213, 214, 215, 216, 221/227; 271/18.3, 141

[56] References Cited

U.S. PATENT DOCUMENTS

| | | | |
|---|---|---|---|
| 494,444 | 3/1893 | Salter et al. | |
| 1,151,347 | 8/1915 | Dueber. | |
| 1,794,208 | 2/1931 | Scott. | |
| 2,854,168 | 9/1958 | Abrams et al. | |
| 3,042,250 | 7/1962 | Watlington | 221/213 X |
| 3,114,475 | 12/1963 | Etes | 221/215 X |
| 3,747,733 | 7/1973 | Knickerbocker. | |
| 3,934,754 | 1/1976 | Dutro | 271/18.3 X |
| 3,957,175 | 5/1976 | Gordon. | |

*Primary Examiner*—Stanley H. Tollberg
*Attorney, Agent, or Firm*—I. C. Waddey, Jr.; Andrew S. Neely

[57] ABSTRACT

A newspaper dispenser (10) includes a dispensing mechanism (44) in which a carriage (92) is mounted for rolling forwardly and rearwardly on tracks (84) and (86). A transverse bar (126) is rotatably mounted on the carriage (92), and a cocking lever (104) is fixedly mounted on one end of the transverse bar. A pair of pins (134) are mounted in the transverse bar (126). In an engagement position, the pins extend downwardly and towards the front of the dispenser (10) at an angle of approximately 45 degrees. In a disengagement position, the pins extend towards the front of the dispenser (10) in a horizontal orientation. When the carriage (92) is moved along the tracks (84) and (86) towards the rear of the dispenser (10), the cocking lever (104) engages a cocking stop (108) and rotates the pins (134) into an engagement position causing them to pierce a newspaper disposed below the carriage. When the carriage (92) is moved towards the front of the dispenser (10), the pins (134) slidably propel the newspaper out of the dispenser.

35 Claims, 9 Drawing Figures

NEWSPAPER DISPENSER

TECHNICAL FIELD

The present invention relates to a mechanism for slidably propelling a planar item such as a newspaper in a direction within the plane of the planar item, and particularly relates to a newspaper dispenser for dispensing an end newspaper from one end of a stack of newspapers contained within the dispenser.

BACKGROUND OF THE INVENTION

There has long been felt need for a simple, reliable and durable machine for dispensing a newspaper, one at a time, and many machines have been designed for this purpose. Generally, known newspaper dispensers have been found to be unduly complex, delicate, unreliable and too expensive.

A newspaper dispenser must function in a very harsh environment. Typically, newspaper dispensers are located on sidewalks, beside streets, in parking lots, in front of business establishments at curbside, as well as in buildings and other shelters. In these environments, the dispenser will often be exposed during the summer to heat in excess of 100° F. (37.8° C.), direct sunlight, humidity, wind, dust, and rain. In the winter, the dispenser will be exposed to below freezing temperatures, snow, sleet, and rain. Dispensers near streets or in parking lots will be exposed to a water spray from passing cars. Such water often contains salts and oils which pose corrosion and gumming hazards which may interfere with the normal operation of the dispenser. Also, newspaper dispensers will be abused by customers such as by kicking, shaking and striking, and the dispenser will occasionally be bumped by slow moving cars.

To perform reliably in this environment, a newspaper dispenser must be very durable, virtually indestructible. Typically, newspaper dispensers of conventional or known designs are not capable of reliably performing in this type of environment. Such known dispensers often have numerous interdependent moving parts such as sliding parts, ring gears, screw gears, ratchets, push rods and the like that are delicate and require close tolerances in order to function properly. Corrosion and/or oil buildup on these parts can prevent proper functioning, and a sharp blow to the dispenser can misalign these parts causing a malfunction. In short, a complex mechanism with numerous moving parts is not suitable for use in a newspaper dispenser. It is cost prohibitive to manufacture a complex mechanism that is capable of performing reliably in the environment of a newspaper dispenser.

A newspaper dispenser must also be simple to operate and maintain. A newspaper boy is often responsible for loading newspapers into the machine and for maintaining the machine in proper working order. Most newspaper boys are not adept at maintaining or adjusting a complicated machine, and it has been discovered that newspaper boys are often the source of varying degrees of dispenser abuse or missuse. A newspaper dispenser should be capable of withstanding such operator abuse and, yet, performing reliably. Thus, conventional machines requiring fine tuning or adjustments to be made by the operator based on the varying size of daily newspapers or on other factors have proved generally unreliable. Furthermore, complex mechanisms of known newspaper dispensers have proven unacceptably vulnerable to operate abuse and difficult to maintain.

SUMMARY OF THE INVENTION

The foregoing and other problems long associated with newspaper dispensers are solved by the present invention in which a reliable and durable newspaper dispenser is provided. The dispenser of the present invention has a minimum of moving parts, and those parts that must move are designed to operate reliably under the most adverse conditions.

In accordance with the present invention, a mechanism for slidably propelling a single substantially planar item in a direction within the plane of said item includes a transverse bar positioned adjacent the planar item. The transverse bar is mounted for rotation about the center axis of the transverse bar in its position adjacent the planar item. The mounting of the transverse bar also provides for linear motion in a direction parallel to the planar item. The transverse bar is movable through such linear motion between a retracted position and a dispensing position. At least one pin is mounted on the transverse bar and is moveable by the rotation of the transverse bar between an engagement position and a disengagement position. The pin is positioned to engage the planar item when in the engagement position and to disengage the planar item when in the disengagement position. An actuator is mechanically connected to the transverse bar for moving the transverse bar between the retracted position and the dispensing position. A cocking lever extends from the transverse bar, and a cocking stop is positioned to selectively engage the cocking lever. As the transverse bar moves from the dispensing position to the retracted position, the cocking lever engages the cocking stop to cock the lever thereby rotating the transverse bar to move the pin into the engagement position when the transverse bar is moved completely to the retracted position. The pin is operable to engage and slidably propel the planar item in a linear direction when the transverse bar is moved by the actuator from the retracted position to the dispensing position.

The interaction of the pin, the transverse bar, the cocking lever and the cocking stop provides a reliable mechanism that is an important aspect of the present invention. One important function that must be performed in a dispenser is reliably engaging the item to be dispensed. By mounting the pin on the transverse bar, the pin may be forced to engage and disengage the planar item with a simple rotation of the transverse bar. The degree or depth of engagement of the pin with the planar item is determined by the length of the pin, the distance between the planar item and the transverse bar, and the amount of rotation of the transverse bar. These factors may be easily controlled even under adverse conditions.

The cocking lever and the cocking stop act to translate the linear motion of the transverse bar into rotational motion thereof. The linear travel and the rotational movement of the transverse bar are interdependent so that a limitation on one is a limitation on the other. In this configuration stops may be employed to limit both the linear and the rotational movement of the transverse bar, and each stop will act as a check on the other, thus, providing increased reliability. Also, the cocking lever and the cocking stop reliably produce rotational movement without the use of gears, pulleys, chains, belts or the like that may be found in other known devices which are unduly vulnerable to failure in adverse conditions.

In accordance with a particular aspect of the present invention, the mechanism for slidably propelling a single substantially planar item is mounted in a housing containing a stack of newspapers. A passage is formed in the housing for receiving and transmitting newspapers from within the housing to without the housing. When the transverse bar is moved to the retracted position, the cocking lever and cocking stop interact to rotate the transverse bar so that the pin moves to the engagement position and pierces the end newspaper to a predetermined depth. The mechanism is oriented within the housing so that as the transverse bar is moved by the actuating means from the retracted position to the dispensing position, the pin propels the end newspaper through the passage. In the preferred embodiment, two pins are mounted on the transverse bar for propelling the end newspaper through the passage.

In accordance with another aspect of the present invention, stop bolts are provided for limiting the rotation of the transverse bar between first and second angular positions. The pins on the transverse bar are oriented in the engagement position when the transverse bar is rotated to the first angular position and are oriented in the disengagement position when the transverse bar is rotated to the second angular position.

In accordance with another aspect of the present invention, a following roller is mounted adjacent the transverse bar. The following roller includes an axle and a pair of rollers rotatably mounted in a spaced apart relationship on the axle. A coil spring is mounted on the axle between the rollers and exerts an outward force on each of the rollers in a direction parallel to the axle. Mounting structure is provided for mounting the axle adjacent the transverse bar and for retaining the rollers on the axle. The following roller maintains the transverse bar at a predetermined spacing distance from the end newspaper.

In accordance with another particular aspect of the present invention, the transverse bar is rotatably mounted on a carriage, and a pair of upper tracks extend in a parallel spaced apart relationship to the end newspaper. A pair of lower tracks extend in an adjacent parallel spaced apart relationship with the pair of upper tracks, and the newspaper is disposed below the lower tracks. Two pairs of upper wheels are mounted on the carriage with one pair of the upper wheels being mounted on each end of the carriage. The upper wheels roll on the lower surfaces of the upper tracks. Two lower wheels are mounted on the carriage with one of the lower wheels being mounted on each end of the carriage. The lower wheels roll on the upper surfaces of the lower tracks. The upper and lower wheels are operable to transport the carriage along the upper and lower tracks for moving the transverse bar between the retracted position and the dispensing position. Lower retaining flanges extend along the inside edges of the lower tracks, and upper retaining flanges extend along the outside edges of the upper tracks to retain the upper and lower wheels of their respective tracks.

In accordance with yet another particular aspect of the present invention, a spring structure is in mechanical communication with the transverse bar for exerting a force thereon in a direction for moving the transverse bar towards the retracted position. A hydraulic mechanism is also connected to yieldably resist the motion of the transverse bar towards the retracted position. Thus, the transverse bar is spring driven back toward the retracted position, but the hydraulic mechanism cushions the return of the transverse bar to the retracted position.

In accordance with yet another particular aspect of the present invention, a middle pressure bar having one end mounted adjacent the rear of said housing and extending along the mid-region of the end newspaper between the transverse bar and the end newspaper is oriented in a direction parallel to the direction of the travel of the transverse bar. The other end of the middle pressure bar is spring mounted adjacent the front of the housing. In this construction, the middle pressure bar is spring biased against the end newspaper to apply a uniform pressure along the mid-region of the newspaper.

BRIEF DESCRIPTION OF THE DRAWING

The present invention may best be understood by those of ordinary skill in the art by reference to the following Detailed Description when considered in conjunction with the Drawings in which.

DETAILED DESCRIPTION

Figure 1:
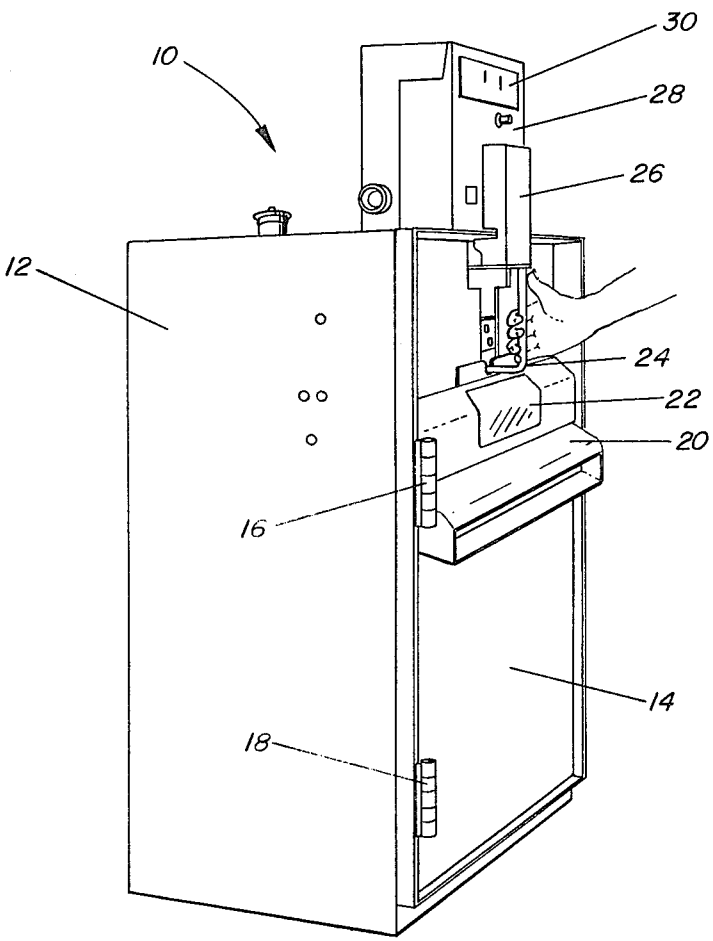
FIG. 1 is a perspective view of the newspaper dispenser of the present invention showing the handle in a retracted position.

Referring now to the Drawings, in which like reference characters designate like or corresponding parts throughout the several views, there is shown in FIG. 1 a newspaper dispenser 10 embodying the present invention. The dispenser 10 includes a housing 12 with a door 14 mounted on the front thereof by hinges 16 and 18.

The door 14 includes a dispensing chute 20 and passageway for dispensing newspapers from within the dispenser 10. Also, a window 22 is formed in the door covered by a transparent material such as glass or plastic. A view through the window 22 enables a potential customer to determine whether the dispenser 10 contains newspapers or the like.

A handle 24 is disposed above the door 14 and is shown in a retracted position in FIG. 1. A latch head 26 is mounted on the handle 24 and extends upwardly for engagement with a coin operated locking mechanism 28. When the handle 24 is in the retracted position, the latch head 26 is latched or secured to the locking mechanism 28. By inserting the appropriate combination of coins into a coin receiver 30, the locking mechanism 28 unlocks and releases the latch head 26.

Figure 2:
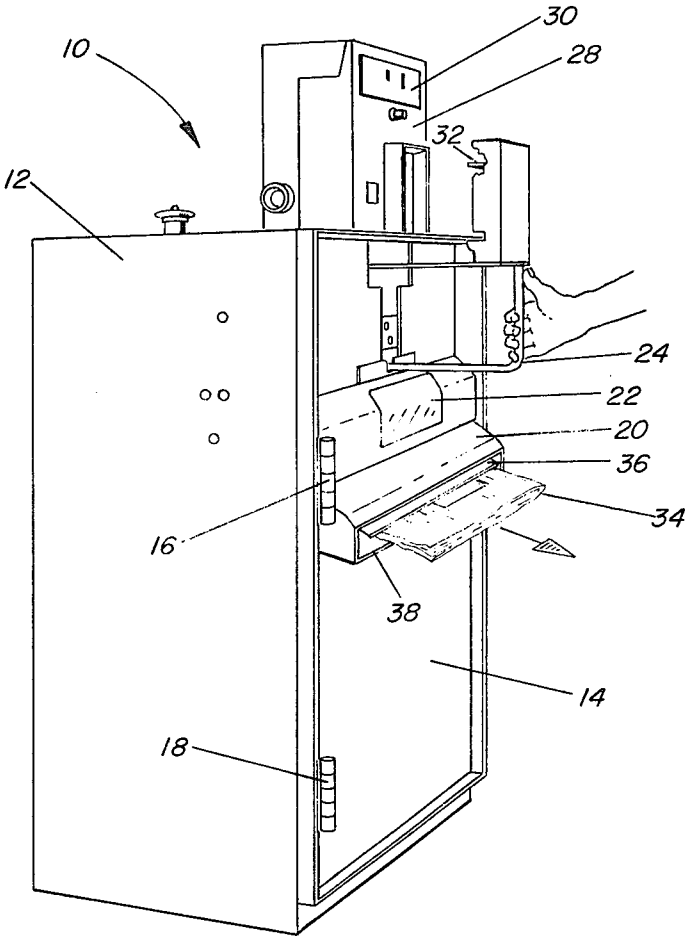
FIG. 2 is a perspective view of the newspaper dispenser showing the handle in the dispensing position with a newspaper extending through a dispensing chute.

Referring now to FIG. 2, the dispenser 10 is shown with the handle 24 in the dispensing position. The handle 24 is moved from the retracted position to the dispensing position by inserting coins into the receiver 30 and pulling the handle 24 away from the dispenser. In FIG. 2, a latching tongue 32 is shown extending from the latch head 26. When the handle 24 is moved to the retracted position, the tongue 32 is locked within the locking mechanism 28. The locking mechanism 28 and associated structure is a conventional mechanism.

When the handle 24 is pulled to the dispensing position as shown in FIG. 2, a newspaper 34 is propelled from within the dispenser 10 through the chute 20 to the position shown in FIG. 2. As the newspaper 34 passes through the chute 20, a chute flap 36 that is hingedly mounted to the top inside surface of the chute 20 is forced open. The function of the chute 20 and the flap 36 is, first, to prevent the easy removal of newspapers from within the dispenser 10. The chute 20 is somewhat funnel-shaped so that the exposed chute opening 38 is small enough to impede the insertion of a hand into the chute. The flap 36 is easily pushed open by the newspaper 34, but it would be difficult for a thief to open the flap from the outside of the dispenser 10. Secondly, the chute 20 and the flap 36 serve to prevent rain, dust and the like from entering the dispenser 10.

Figure 3:
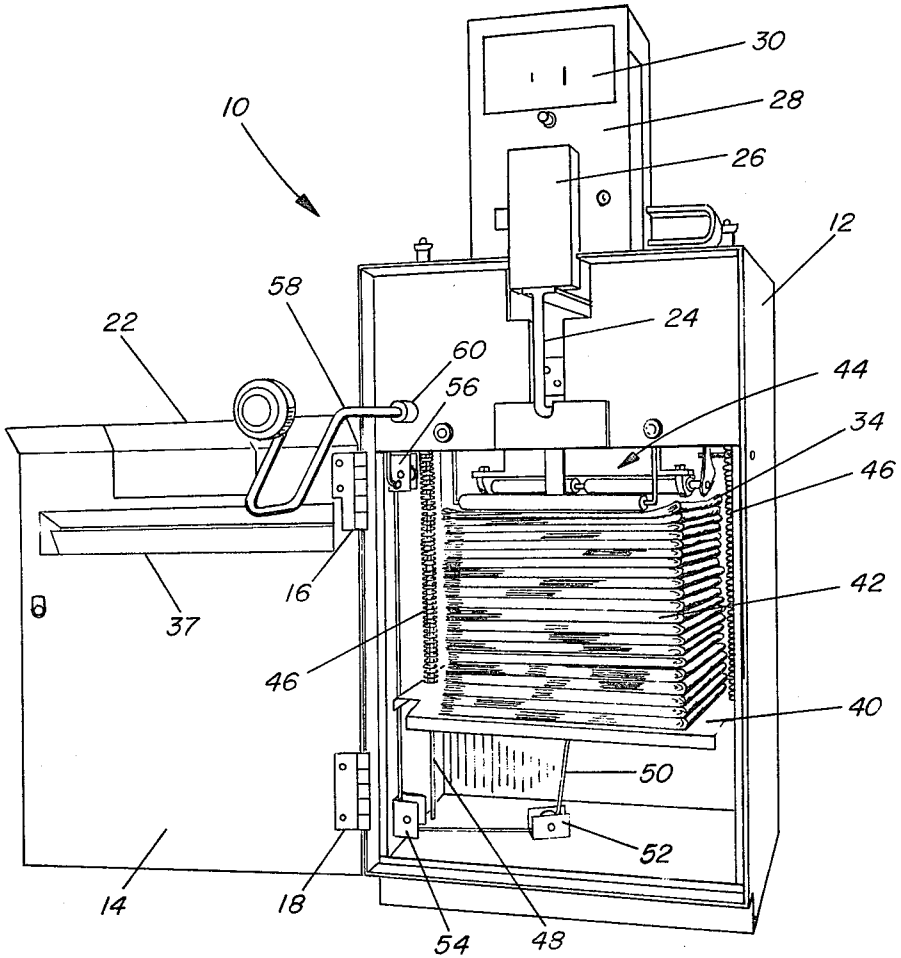
FIG. 3 is a front view of the newspaper dispenser showing the dispenser door in an open position.

A front view of the dispenser 10 with the door 14 in an open position is shown in FIG. 3. A paper tray 40 is mounted within the housing 12 supporting a stack of newspapers 42. The paper tray 40 is supported by a pair of springs 46 that force that stack of newspapers 42 upwardly towards and against the dispensing mechanism 44. The springs 46 and the paper tray 40 are mounted on vertical rods 48 which maintain the springs and the paper tray in the same lateral position within the dispenser 10 but allow vertical movement of the tray.

By selecting springs 46 to have a proper spring constant and dimensions, the springs 46 provide a generally uniform or constant upward force against the dispensing mechanism 44. The springs 46 are chosen so that the upward force placed on the tray 40 is approximately two to five pounds greater than the weight of the newspapers 42, regardless of the size of the stack of newspapers. Thus, approximately two to five pounds of upward force is applied through the newspapers 42 to the dispensing mechanism 44.

As the newspapers 42 are removed from the dispenser 10, the stack of newspapers grows smaller and the overall weight of the newspaper decreases. However, as the newspapers 42 are removed from the dispenser 10, the stretching distance of the springs 46 also decreases, and the upward force of the springs on the tray 40 decreases by an amount approximately equal to the weight of the newspapers which were removed. Thus, the upward pressure on the dispensing mechanism 44 is maintained at a constant force.

To facilitate the insertion of newspapers onto the tray 40, the tray 40 may be lowered using a nylon rope 50. The nylon rope 50 is attached to the bottom of the tray 40, and passes around a pulley 52 mounted on the bottom of the dispenser housing 12. The rope extends through a pulley 54 mounted on the bottom of the side wall of the housing 12, passes through a pulley 56 mounted on the side wall of the housing 12 above the pulley 54 and is wound on a winch 62 (shown in FIG. 4).

The rope 50 is tensioned to pull the tray 40 downwardly using a crank 58. The crank 58 includes a socket 60 that is placed on mating receiving structure and used to drive the winch 62 which is located within the dispenser 10 immediately above pulley 56. Thus, by rotating the crank 58, the rope 50 is tensioned and the paper tray 40 is pulled downwardly towards the bottom of the dispenser housing 12.

Figure 4:
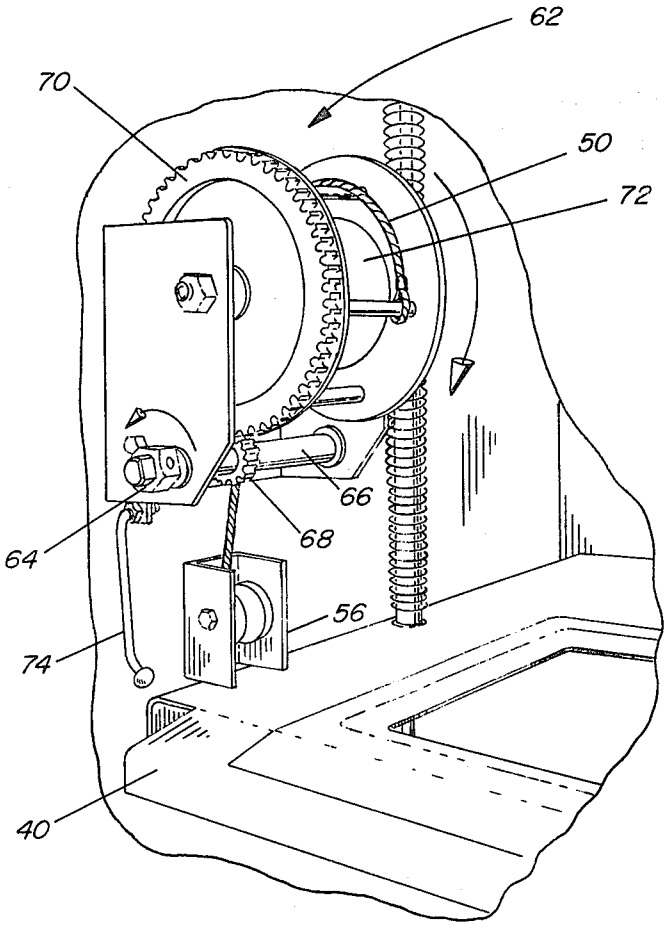
FIG. 4 is a detailed view of a winch used to lower a paper tray in the newspaper dispenser.

The winch 62 that is used to tension the rope 50 is shown in detail in FIG. 4. The winch 62 includes a head 64 that is dimensioned to mate with the socket 60. The head 64 is shown as a hexagonal nut or bolt head, but it will be understood that any suitable mating socket and head may be used in the present invention. Rotation of the head 64 rotates a shaft 66 and a gear 68. The gear 68 drives a ring gear 70 which in turn drives spool 72. The rope 50 is attached to the spool 72 and wound thereon. Thus, when the head 64 is rotated, the spool 72 rotates to tension the rope 50.

The winch 62 includes a ratchet (not shown) which is controlled by a lever 74. As the paper tray 40 is being winched downwardly, the lever 74 is moved to the ratchet position, and the ratchet prevents the spool 72 from feeding out the rope 50. Thus, when the tray 40 is moved to the desired position, the winch 62 will hold the tray in that position. However when the papers have been inserted the lever 74 is rotated to release the ratchet and allow the springs 46 to force the papers 42 upwardly.

Figure 5:
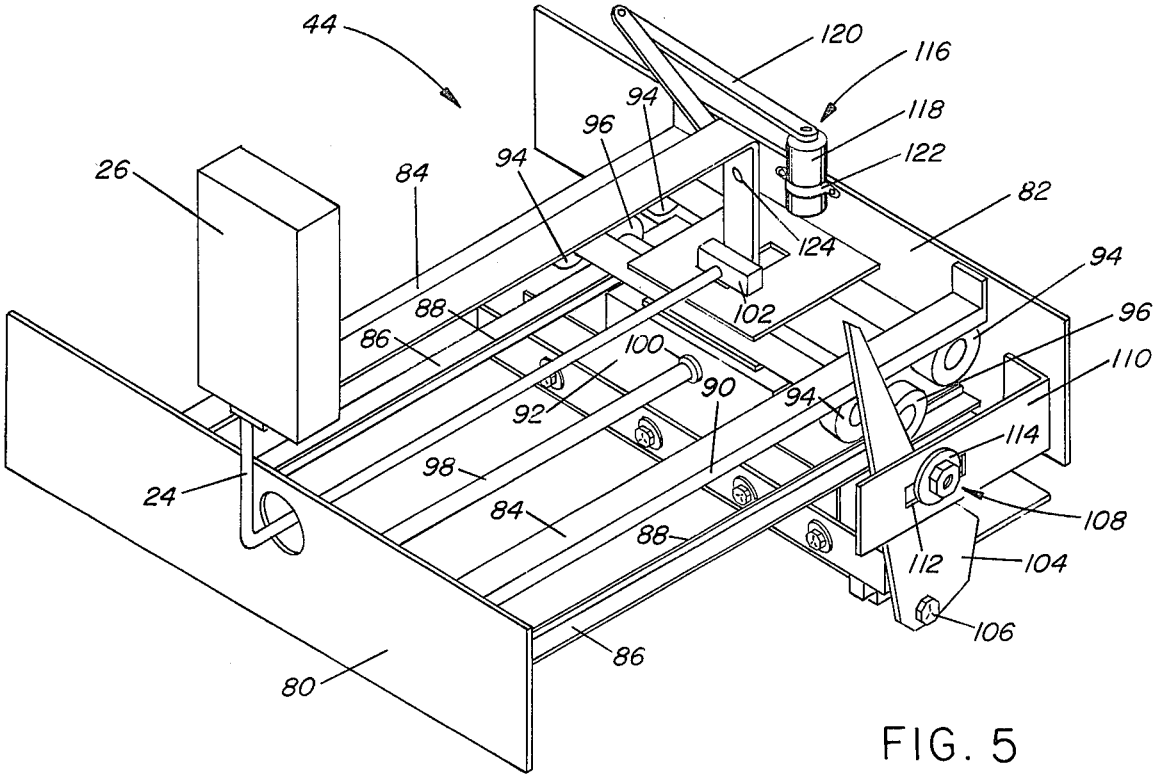
FIG. 5 is a top isometric view of the dispensing mechanism of the newspaper dispenser.

Referring now to FIG. 5, there is shown an isometric detailed view of the dispensing mechanism 44 removed from the housing 12. The mechanism 44 includes a front mounting plate 80 and a rear mounting plate 82 that are bolted within the dispenser housing 12 to mount the mechanism 44 therein. A pair of upper tracks 84 and a pair of lower tracks 86 extend between the mounting plates 80 and 82 in a generally perpendicular orientation relative to the plates with the lower tracks 86 disposed directly and parallel to the upper tracks 84. The lower tracks include upwardly extending retaining flanges 88 along the interior side thereof, and the upper tracks 84 have downwardly extending retaining flanges 90 disposed along their outer edges.

A carriage 92 is mounted for rolling action along the tracks 84 and 86 by means of two pairs of upper wheels 94 and one pair of lower wheels 96. The upper wheels 94 roll on the lower surfaces of the upper tracks 84 and are retained within the tracks 84 by the retaining flanges 90. The lower wheels 96 roll upon the upper surfaces of the lower tracks 86 and are retained within the tracks by the retaining flanges 88. In this construction, the carriage 92 is movable along the tracks 84 and 86 from the retracted position shown in FIG. 5 forward towards the front mounting plate 80.

A center guide rod 98 also extends from the front mounting plate 80 to the rear mounting plate 82, and a cylindrical slideway 100 is formed in the carriage 92 for receiving the center guide rod 98. As the carriage 92 rolls forwardly and rearwardly along the tracks 84 and 86, the slideway 100 is in contact with the center guide rod 98 and maintains the carriage 92 in a position centrally disposed between the tracks 84 and 86. Thus, the retaining flanges 88, the retaining flanges 90, and the center guide rod 98 all serve to maintain the carriage 92 oriented generally perpendicularly to the tracks 84 and 86 with the wheels 94 and 96 retained on the tracks. It will be appreciated that twisting motion of the carriage 92, as well as lateral movement, is prevented by this above described mounting structure for the carriage.

The handle 24 is used an an actuator or force translator to move the carriage 92 along the tracks 84 and 86 from a retracted position to a dispensing position.

The retracted position shall be defined as the position of furthermost travel of the carriage 92 towards the rear mounting plate 82, and the dispensing position shall be defined as the position of furthermost travel of the carriage 92 towards the front mounting plate 80.

The handle 24 is attached to a mounting block 102 that is welded, bolted or otherwise conventionally attached to the carriage 92.

The carriage 92 is shown in the retracted position in FIG. 5. In the retracted position, a cocking lever 104 is in a cocked position engaging a cocking stop 108. The cocking lever 104 is fixedly mounted on a bolt 106 that is rotatably mounted on the carriage 92. Thus, the cocking lever 104 rotates with bolt 106.

The cocking stop 108 is positioned in the path of the cocking lever 104 so that as the carriage 92 moves rearwardly from the dispensing position towards the retracted position, the cocking lever 104 engages the cocking stop 108. As the carriage 92 continues movement towards the retracted position, the cocking lever 104 slides against the cocking stop 108, and is forced upwardly into the cocked position shown in FIG. 5.

The cocking stop 108 is mounted in a slot 112 in an arm 110 by means of a nut and washer 114. The arm 110 is mounted on the rear mounting plate 82 and extends therefrom in a direction generally parallel to the tracks 84 and 86. The position of the cocking stop 108 may be adjusted by loosening the nut and washer 114 and moving the stop 108 along the slot 112.

A return control mechanism 116 is provided to control the return of the carriage 92 from a dispensing position to the retracted position. The return control mechanism 116 includes a cylinder 118 that is secured to the rear mounting plate 82 by a strap 122. The strap 122 is welded to the cylinder 118 and is bolted to the rear mounting plate 82. A scissor arm 120 extends from the top of the cylinder 118 and is pivotally attached to the handle 24 using a conventional hinge structure. A bolt 124 is shown in FIG. 5 on the handle 24 for securing the scissor arm 120 to the handle.

The cylinder 118 contains a spring and a hydraulic mechanism. As the carriage 92 is pulled forward towards the front mounting plate 80, the spring within the cylinder 118 is tensioned. When the handle 24 is released, the spring within the cylinder 118 pulls the carriage back towards the rear mounting plate 82 by means of the scissor arm 120. The hydraulic system within the cylinder 118 cushions the return of the carriage 92 towards the retracted position adjacent the rear mounting plate 82 and, thus, prevents the carriage 92 from slamming back into the retracted position.

The return control mechanism 116 is of conventional design. Such mechanisms are commonly used as door return mechanisms. Although the return control mechanism 116 is conventional in nature, the use of such return control mechanism 116 in combination with the dispensing mechanism 44 is considered novel.

Figure 6:
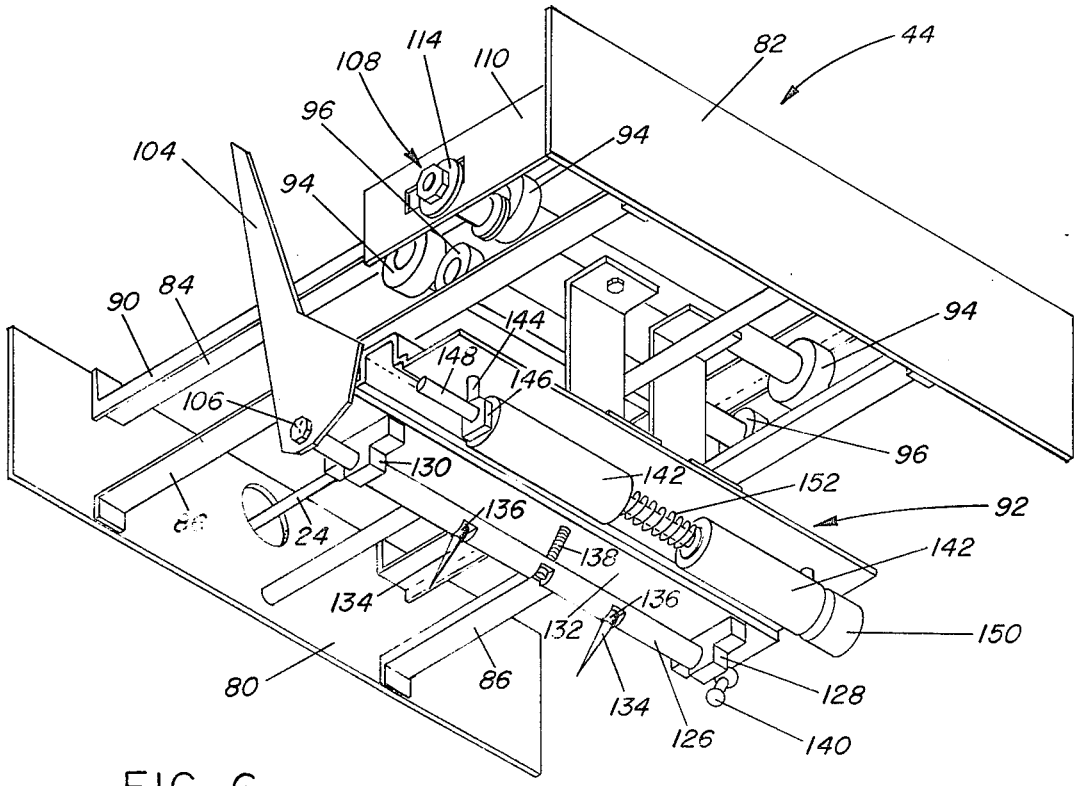
FIG. 6 is a bottom isometric view of the dispensing mechanism with a pair of pins shown in an engagement position.

Referring now to FIG. 6, there is shown an isometric view of the underside of the dispensing mechanism 44. In this view, the cocking lever 104 is shown in the cocked position, and the carriage 92 has rolled forward towards the front mounting plate 80. Thus, the carriage 92 is shown approximately halfway between the retracted position and the dispensing position.

In FIG. 6, it may be seen that a transverse bar 126 is rotatably mounted below the carriage 92. The transverse bar 126 is mounted in bearing boxes 128 and 130 which, in turn, are bolted to a lower surface 132 of the carriage 92. A pair of pins 134 are mounted in the transverse bar 126 and, in the engagement position shown in FIG. 6, the pins extend downwardly at an angle of approximately 45 degrees and are oriented pointing towards the front mounting plate 80. In the preferred embodiment, the pins include threaded bases 136 which are received into threaded holes in the transverse bar 126.

Figure 7:
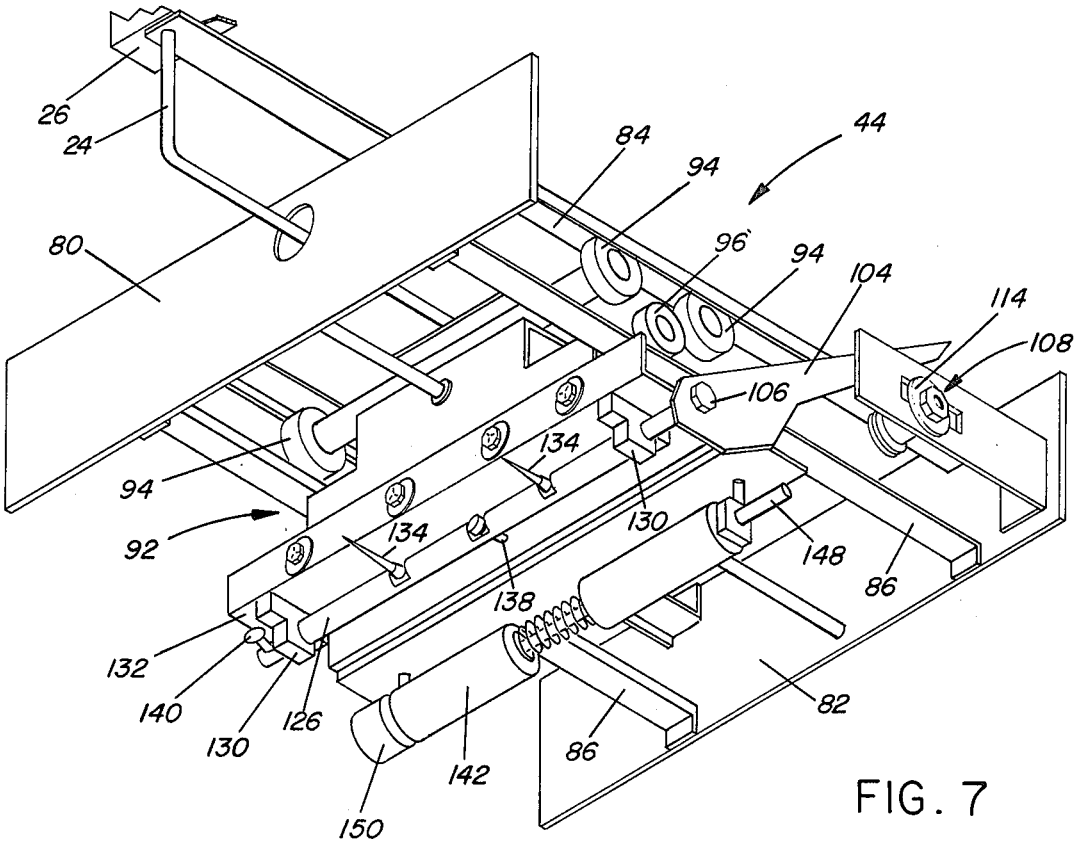
FIG. 7 is a bottom isometric view of the dispensing mechanism with a pair of pins shown in a disengagement position.

Referring now to FIGS. 6 and 7, it may be appreciated that the transverse bar 126 is rotatable in the bearing boxes 128 and 130 for rotating the pins 134 between an engagement position as shown in FIG. 6 to a disengagement position as shown in FIG. 7. A stop bolt 138 is threadedly attached through the transverse bar 126. When the pins 134 are in the engagement position, the stop bolt 138 engages the lower surface 132 of the carriage 92 and prevents further downward rotation of the pins 134 thereby maintaining the pins 134 in the engagement position. Another stop bolt 140 is threadedly mounted on the end of the transverse bar 126 and stops the rotation of the pins 134 in the upward direction when the transverse bar and pins are in the disengagement position.

The bolt 106 is fixedly attached to both the cocking lever 104 and the transverse bar 126. The cocking lever 104 and the transverse bar 126 rotate in unison with the cocking lever 104 functioning to selectively exert a rotational force on the transverse bar 126 through the bolt 106.

A pair of following rollers 142 are mounted behind the transverse bar 126, and a pair of support bars 144 extend downwardly from the carriage 92 with bearing plates 146 being formed on the end of the support rods. The bearing plates 146 include a cylindrical aperture or race for receiving an axle 148. The axle 148 rotates in the bearing plates 146, and the rollers 142 may rotate in unison with the axle and may also rotate independently of the axle.

On both ends of the axle 148 outside of the bearings plate 146, a small end roller 150 is mounted. The end roller has been omitted on one end of the axle 148 throughout the figures for purposes of illustration only. The end rollers 150 are attached to the axle and function to hold the axle in place in the bearing plates 146.

The rollers 142 are slidably mounted on the axle 148 and, thus, may move axially along the axle 148. A coil spring 152 is mounted between the rollers 142 and encompassing the axle 148. The spring 152 exerts an outward force on each of the rollers 142 and, under normal operating conditions, maintains the rollers 142 against the bearing plates 146. However, spring 152 will yield in response to forces applied to the rollers 142 and allow the rollers 142 to move inwardly along the axle 148. In response to forces from a newspaper, the rollers 142 may move inwardly. This yielding action of the rollers 142 helps prevent damages to the newspaper against which the rollers operate.

The rollers 142 are mounted to engage a stack of newspapers below the dispensing mechanism 44 and are disposed a predetermined distance lower than the transverse bar 126. However, the lowermost edge of the rollers 142 are higher than the tips of the pins 134 in the engagement position. When the pins 134 are cocked to the engagement position, the pins 134 pierce the newspaper below the dispensing mechanism 44, but the transverse bar 126 remains spaced apart from the newspapers.

Referring now to FIG. 7, an underside view of the newspaper dispensing mechanism 44 is shown with the pins 134 in the disengagement position. The carriage 92 is between the retracted position and the dispensing position, the cocking lever 104 is in the uncocked position. When the pins 134 are in the disengagement position, neither the pins 134 nor the transverse bar 126 engage newspapers below the dispensing mechanism 44. The following roller 142 is operable to maintain the transverse bar 126 in a spaced apart position from the newspapers below.

In the disengagement position, the pins 134 are in a basically horizontal position pointed slightly upwardly and toward the front mounting plate 80. The stop bolt 140 engages the lower surface 132 of the carriage 92 and prevents further upward rotation of the transverse bar 126 and the pins 134, thus, maintaining the pins in the disengagement position. Also, the bolt 140 stops the downward rotation of the cocking lever 104 and maintains the cocking lever 104 in the uncocked position.

The operation of the dispensing mechanism 44 may be understood by collective reference to FIGS. 3, 5, 6 and 7. In FIG. 3, it is shown that a stack of newspapers 42 is disposed below the dispensing mechanism 44 and forced upwardly towards it.

In FIG. 5, the dispensing mechanism 44 is shown as it would appear in the retracted position. Thus, the cocking lever 104 has been forced by the cocking stop 108 into the fully cocked position, and the pins 134 have been rotated to the engagement position and would have pierced the end newspaper of the stack of newspapers 42 if disposed below the dispensing mechanism 44 as shown in FIG. 3. When coins are inserted into the coin receiver 30, the handle 24 is released. The handle 24 is pulled forward or away from the dispenser 10, the carriage 92 moves forward towards the front mounting plate 80. Since the pins 134 are in the engagement position and have pierced the newspapers, the end newspaper of the stack of newspapers 42 will be propelled forward along with the carriage 92. The 45 degree angle of the pins 134 (FIG. 6) will tend to lift the newspaper upwardly and further impale the newspaper on the pins 134.

The top newspaper will impart a rearward force on the pins 134 as the carriage 92 is moving forward. Thus, during the dispensing process, the newspaper will exert a force tending to rotate the pins 134 downwardly and rearwardly. The stop bolt 138 will prevent such movement of the pins 134 and, thus, maintain the pins in the engagement position as shown in FIG. 6.

During the dispensing process, while the carriage 92 and the top or end newspaper are being propelled forward, the cocking lever 104 remains in the cocked position as shown in FIG. 6. The cocking lever 104 and the pins 134 will remain in the cocked position and the engagment position, respectively, when the carriage 92 reaches the dispensing position. At this point, the newspaper will be partially protruding from the dispenser.

When the newspaper is pulled forward and removed by the operator (customer), the removal of the newspaper will impart a forward and upward force on the pins 134 tending to rotate them towards the disengagement position. The removal of the newspaper will also begin to rotate the cocking lever 104 towards the uncocked position. In the fully cocked position, the cocking lever 104 was substantially balanced on the bolt 106 so that the cocking lever imparted very little, if any, rotational force on the transverse bar 126. However, when the newspaper is pulled from the dispenser, and the cocking lever 104 begins rotational movement toward the uncocked position, the weight of the cocking lever will impart a rotational force on the transverse bar 126 rotating the pins 134 towards the disengagement position. As the cocking lever 104 falls to the uncocked position, the pins 134 are rotated to the disengagement position.

If for some reason the removal of the newspaper from the dispenser failed to move the pins to the disengagement position, another newspaper would be forced upwardly against the pins 134. This upward force applied by the next newspaper would also tend to rotate the pins 134 upwardly towards the disengagement position. Also, when the handle 24 is released, the carriage 92 will be drawn rearwardly by the return control mechanism 116 towards the retracted position. If for some reason the pins 134 have still not returned to the retracted position, the sliding motion between the pins 134 and the next newspaper as the carriage 92 returns to the retracted position will also impart a rotational force on the pins 134 tending to rotate the pins upwardly towards the retracted position. It will, thus, be appreciated that the dispenser 10 of the present invention has been designed so that during normal operation a multiplicity of forces will tend to return the pins 134 to the disengagement position.

As the carriage 92 returns from the dispensing position to the retracted position, the transverse bar 126 and the cocking lever 104 should be in the position shown in FIG. 7. In this position, the following rollers 142 maintain the transverse bar in a spaced apart relationship with the top newspaper below the dispensing mechanism 44. Thus, with respect to the dispensing mechanism 44, only the rollers 142 engage the newspapers during the return motion to the retracted position.

The cocking stop 108 is disposed in the path of the cocking lever 104 so that as the carriage 92 returns to the retracted position, the cocking lever 104 will engage the cocking stop 108. As the cocking lever 104 is forced against the cocking stop 108 the lever is forced into the cocked position. The lever 104 is positioned with respect to the cocking stop and is configured so that the rotation of the transverse bar 126 due to the cocking lever 104 occurs abruptly near the end of the linear motion of the carriage 92. Thus, when the carriage 92 has almost completely returned to the retracted position, the lever 104 rotates the transverse bar 126 forcing the pins 134 into an engagement position in which the pins pierce the top newspaper of the stack of newspapers 42. Thus, the dispensing mechanism again assumes the position shown in FIG. 5, and the dispensing cycle may begin again.

In the design of the dispensing mechanism 44, it is important that the pins 134 do not engage or pierce the newspapers 42 until the carriage 92 is very near the fully retracted position. This factor is important so that the latch head 26 will be locked by the coin operated locking mechanism before the pins 134 pierce the newspaper. Otherwise, newspapers could be repetitively dispensed from the dispenser 10 without inserting coins into the coin receiver 30 by simply allowing the carriage to move rearwardly towards the retracted position until the pins pierce the newspaper and then pulling the handle again. By adjusting the position of the cocking stop 108 in the slot 112 during the assembly of the dispenser 10, the operation of cocking the cocking lever 104 is adjusted so that the latch head 26 locks with the locking mechanism 28 before the pins 134 pierce the end newspaper of the stack of newspapers 42.

Figure 8:
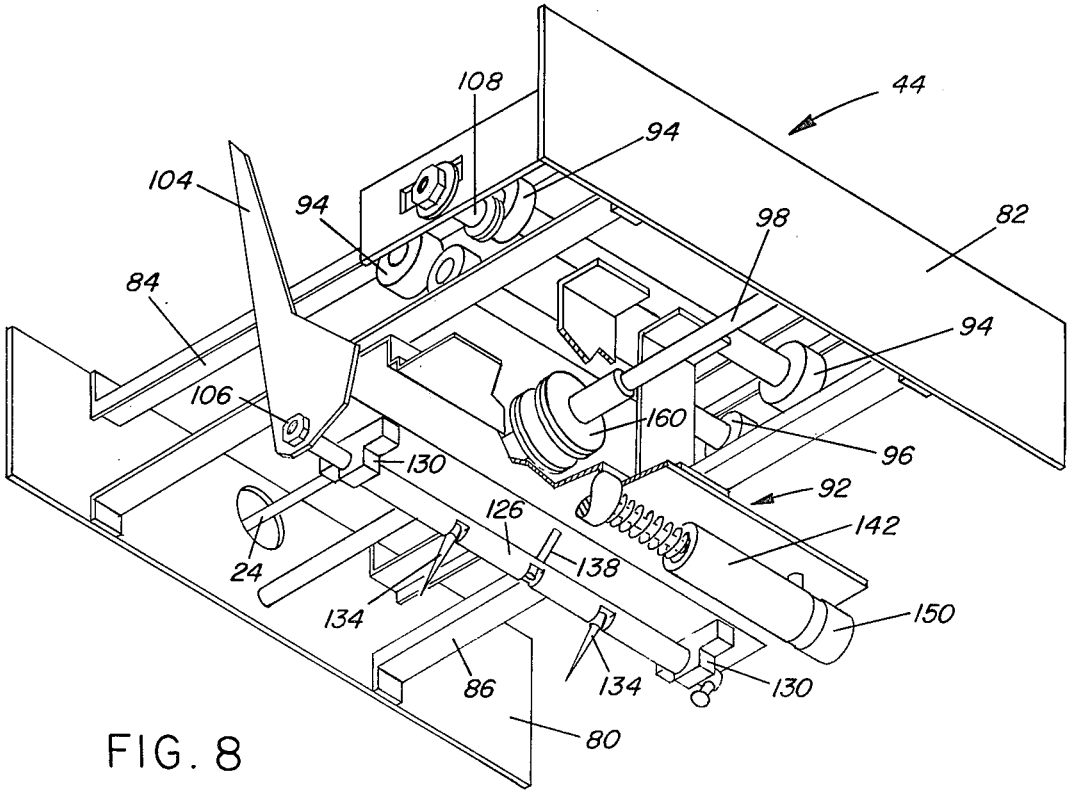
FIG. 8 is a bottom isometric view of the dispensing mechanism shown with portions thereof broken away to show the center guide rod and corresponding slideway.

Referring now to FIG. 8, there is shown an underside view of the dispensing mechanism 44 with portions thereof broken away to reveal a radial bearing 160. The radial bearing 160 is conventional in design and rolls along the cylindrical center guide rod 98. The radial bearing 160 rolls rather than slides along the center guide rod 98 so that the possibility of the carriage 92 becoming stuck or jammed on the center guide rod 98 is minimized.

As previously described, the principal function of the center guide rod 98 in association with the radial bearing 160 is to center and guide the carriage 92 to prevent twisting or lateral movement of the carriage. To accomplish this purpose, the radial bearing 160 is securely mounted on the carriage 92 in a conventional manner.

The dispensing mechanism 44 has been designed to minimize the possibility of a jam. It has been discovered that slide bars for supporting the carriage 92 were unduly susceptible to jamming and, therefore, not acceptable for use in a newspaper dispenser. Thus, sliding action has been avoided in the present dispensing mechanism 44. The vertical forces that are applied to the carriage 92 are principally borne by the wheels 94 and 96 on the tracks 84 and 86, respectively. Although the stack of newspapers 42 usually applies approximately five pounds of upward force to the carriage 92, the dispensing mechanism 44 will operate properly even with an upward force of 100 pounds applied through the newspapers on the carriage 92. The center guide rod 98 is designed to flex slightly in response to a load applied thereon through the radial bearing 160. In this manner, little force is actually applied through the radial bearing 160 to the center guide rod 98, and most of the vertical forces on the carriage 92 is borne by the wheels 94 and 96.

Figure 9:
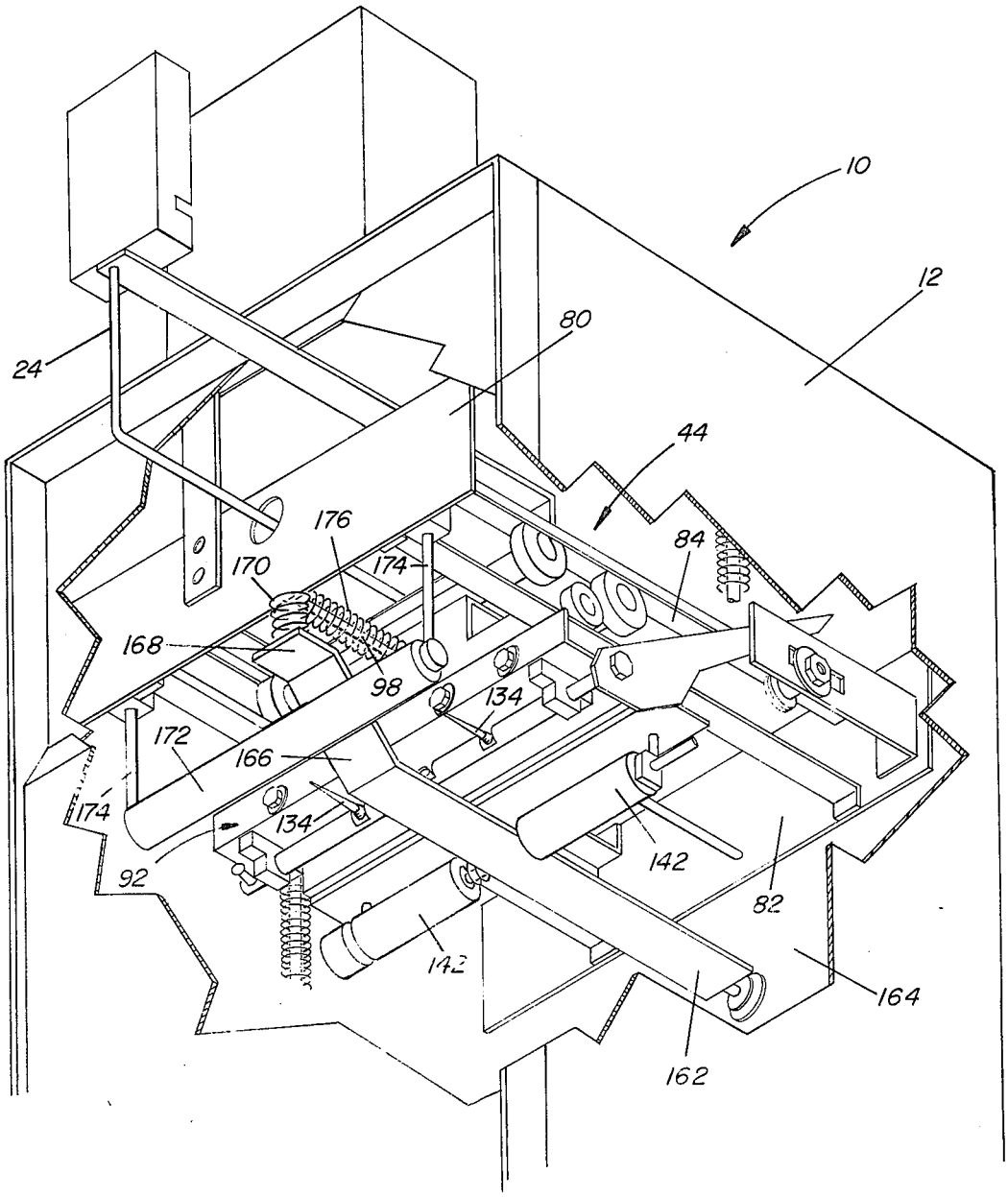
FIG. 9 is an isometric view of the dispenser shown broken away to illustrate the mounting of the dispensing mechanism within the dispenser

Referring now to FIG. 9, the newspaper dispenser 10 is shown mounted in the dispenser 10 with portions of the housing 12 broken away for illustration purposes. The front mounting plate 80 and the rear mounting plate 82 of the dispensing mechanism 44 are secured by conventional means to the interior of the housing 12 so that the dispensing mechanism 44 is disposed in a generally horizontal position. The tracks 84 and 86 are oriented in a horizontal position running from the rear of the dispenser 10 to the front thereof, and the carriage 92 is free to roll from a retracted position to a dispensing position along the tracks 84 and 86.

A midrib bar 162 is pivotally attached to the rear wall 164 of the housing 12 and extends perpendicularly therefrom towards the front of the dispenser 10. The front portion 166 of the midrib 162 is angled upwardly at approximately 45 degrees, and a horizontal lip 168 extends from the top of the front portion 166. The lip 168 is attached to a spring 170 that is mounted on the front mounting plate 80. The midrib bar 162 extends through the gap between the following rollers 142.

The function of the midrib bar 162 is to apply an even downward force along the mid region of the newspaper 34 and prevents the newspapers from bowing in the center and interfering with the operation of the dispensing mechanism 44. By mounting the midrib bar 162 with the spring 170, the bar 162 is operable to apply a constant and consistent force downwardly on the newspapers 42, and it is not necessary to adjust the position of the bar 162.

A front roller 172 is mounted on the front mounting plate 80 by mounting rods 174. The front roller 172 is positioned to engage the front edge of the newspapers 42 as shown in FIG. 3 with the lower edge of the front roller 172 being approximately level with the following rollers 142 and the lowermost portion of the midrib bar 162. Thus, the combined downward forces of the midrib bar 162, the following rollers 142 and the front roller 172 operates to maintain the end newspaper of the stack of newspapers 42 in a horizontal position for reliable dispensing by the dispensing mechanism 44.

Referring to FIGS. 1, 2, 3, and 9, it will be appreciated that the front roller 172 is positioned slightly lower than the top of the newspaper passage 37 and the top of the dispensing chute 20. Thus, the front roller 172 holds the top newspaper of the stack of newspapers in a position adjacent to the passage 37. When the dispensing mechanism 44 propels the top newspaper horizontally, the front roller 172 assures that the newspaper is directed towards the passage 37 and is dispensed from within to without the housing 12.

If an additional return force is required or desired on the carriage 92, a spring, such as a guide rod spring 176 may be mounted on the center guide rod operating between the front mounting plate 80 and the carriage 92. When the handle 24 is pulled forward to the dispensing position and released, the spring 176 will force the carriage 92 and the handle 24 back towards the retracted position. Also, a spring may be mounted on the transverse bar 126 to bias the rotation thereof towards the disengagement position. A coil spring encompassing the transverse bar 126 and attached to the transverse bar and to the lower surface 132 of the carriage 92 would be suitable for biasing the rotation of the transverse bar.

Although a particular embodiment has been described in the foregoing detailed description, it will be understood that the present invention is capable of numerous rearrangements, modifications and substitutions of parts without departing from the spirit of the invention.

I claim:

1. A mechanism for slidably propelling a single substantially planar item in a direction substantially within the plane of said planar item, comprising:

a transverse bar position adjacent to the planar item;

mounting means for mounting the transverse bar adjacent to the planar item, said transverse bar being movable through linear motion between a retracted position and a dispensing position;

at least one pin mounted on said transverse bar and being movable by the rotation of said transverse bar between an engagement position and a disengagement position, said pin being positioned to engage the planar item when in the engagement position and to disengage the planar item when in the disengagement position;

a cocking lever extending from said transverse bar;

a cocking stop positioned to selectively engage said cocking lever;

said cocking lever being oriented to engage the cocking stop as the transverse bar moves in a direction from the dispensing position toward the retracted position, said cocking stop being operable to cocking said lever to rotate and transverse bar to place said pin in the engagement position when said transverse bar is in the retracted position;

said pin being operable to engage and slidably propel said planar item in a linear direction when said transverse bar is moved from the retracted position to the dispensing position.

2. The mechanism of claim 1 further comprising:

stop needs for limiting the rotation of said transverse bar between first and second angular positions, said pins being oriented in the engagement position when said transverse bar is rotated to the first angular position and being oriented in the disengagement position when said transverse bar is rotated to the second angular position.

3. The mechanism of claim 1 further comprising:

a following roller mounted in a spaced apart parallel relationship with said transverse bar and being operable to move linearly with said transverse bar in a direction co-planar with the planar item, said following roller being operable to maintain said transverse bar spaced apart from the planar item at a predetermined spacing distance.

4. The mechanism of claim 3 wherein said following roller comprises:

an axle supported on said mounting means;

a pair of rollers mounted in a spaced apart relationship on said axle;

a coil spring mounted on said axle between said pair of rollers and being operable to exert outward forces on each of said rollers; and support structure fixedly attached adjacent to each end of said axle for mounting said axle on said mounting means and for retaining said rollers on said axle.

5. The mechanism of claim 1 wherein said mounting means comprises:

a carriage;

means for rotatably mounting said transverse bar on said carriage;

a pair of tracks extending in a parallel spaced apart relationship with respect to said planar item; and wheels mounted on each end of said carriage for rolling in said tracks to transport said transverse bar between the retracted position and the dispensing position.

6. The mechanism of claim 5 further comprising:

a center guide rod oriented in a position parallel with the linear motion of said carriage and generally perpendicular to said transverse bar;

a slideway formed in said carriage for receiving and sliding on said center guide rod; and said center guide rod being operable to maintain said carriage in a position centered between said tracks as said carriage moves said transverse bar between the retracted position and the dispensing position.

7. The mechanism of claim 1 when said mounting means comprises:

a carriage;

means for rotatably mounting said transverse bar on said carriage;

a pair of upper tracks extending in a parallel spaced apart relationship with respect to said planar item;

a pair of lower tracks extending in an adjacent parallel spaced apart relationship with said upper tracks, said planar item being disposed below said lower tracks;

two pairs of upper wheels, one pair of said upper wheels being mounted on each of said carriage, for rolling on the lower surfaces of said upper racks;

two lower wheels, one of said lower wheels being mounted on each end of said carriage, for rolling on the upper surfaces of said lower tracks; and said upper and lower wheels being operable to transport said carriage along said upper and lower tracks for moving said transverse bar between the retracted position and the dispensing position.

8. The mechanism of claim 7 further comprising at least one retaining flange mounted on each of said upper and lower tracks to retain said wheels on said tracks.

9. The mechanism of claim 7 further comprising lower flanges extending from the inside edges of said lower tracks to retain said lower wheels thereon; and upper retaining flanges extending from the outside edges of said upper tracks to retain said upper wheels thereon.

10. The mechanism of claim 1 wherein two pins are mounted on said transverse bar in a spaced apart relationship so that the said pins engage the planar item near its midregion.

11. A newspaper dispenser for dispensing an end newspaper from one end of a stack of newspapers, comprising:

a housing containing the stack of newspapers;

a transverse bar disposed within the housing adjacent to the end newspaper;

mounting means for mounting said transverse bar within said housing for rotation about the center axis of said transverse bar and for linear motion of a direction substantially parallel with the plane of the end newspaper, said transverse bar being movable by said linear motion between a retracted position and a dispensing position;

actuating means for moving said transverse bar between the retracted position and the dispensing position;

at least one pin mounted on said transverse bar and being movable by rotation of said transverse bar between an engagement position and a disengagement position, said pin being oriented to engage and pierce the end newspaper of the stack of newspaper when in the engagement position and to disengage the end newspaper when in the disengagement position;

a cocking lever fixedly mounted on said transverse bar and extending outwardly therefrom;

a cocking stop position to selectively engage said cocking lever during the linear motion of said transverse bar;

said cocking lever engaging said cocking stop as said transverse bar moves from the dispensing position to the retracted position to cock said cocking lever and rotate said transverse bar to force said pin into the engagement position when said transverse bar is moved to the retracted position;

said pin being operable to slidably propel the end newspaper in a linear direction along the end of the stack of newspapers when said transverse bar is moved by said actuating means from the retracted position to the dispensing position; and passage means formed in said housing for receiving and transmitting the end newspaper from within said housing to without said housing when said transverse bar is moved by said actuating means from the retracted position to the dispensing position.

12. The newspaper dispenser of claim 11 wherein two pins are mounted on said transverse bar.

13. The newspaper dispenser of claim 12 wherein said two pins are mounted on said transverse bar at spaced apart positions with each pin being inwardly spaced from the lateral edges of the end newspaper at a distance of about ⅓ the width of the newspaper.

14. The newspaper dispenser of claim 12 wherein said two pins are mounted on said transverse bar at spaced apart positions with each pin being spaced approximately three inches from a center line of the end newspaper.

15. The newspaper dispenser of claim 11 further comprising stop means for limiting the rotation of said transverse bar to a rotational movement beween first and second angular position, said pin being oriented in the engagement position when said transverse bar is rotated to the first angular position and being oriented in the disengagement position when said transverse bar is rotated to the second angular position.

16. The newspaper dispenser of claim 11 wherein said cocking lever is disposed in an upright position when said pin is in the engagement position and is disposed in an inclined position when said pin is in the engagement position, so that the weight of said cocking lever exerts a rotational force on said transverse bar in a direction for moving said pin to the retracted position when said cocking lever is in the inclined position and exerts no substantial rotational force on said transverse bar when in the upright position.

17. The newspaper dispenser of claim 11 wherein said pin in the engagement position is inclined downwardly from said transverse bar pointed generally towards said passage means and is upwardly rotatable to the disengagement position, so that removal of the end newspaper from the passage means exerts a force on said pin to rotate said pin upwardly towards the disengagement position.

18. The newspaper dispenser of claim 11 further comprising spring means for exerting a rotational force on said transverse bar in a direction for rotating said pin towards the disengagement position.

19. The newspaper dispenser of claim 11 wherein said actuating means comprises a handle extending through said housing and mechanically connected to the transverse bar so that the transverse bar is movable between the retracted position and the dispensing position in response to forces exerted on said handle.

20. The newspaper dispenser of claim 19 wherein said actuating means further comprises a coin-operated locking mechanism for selectively locking said handle with said transverse bar in the retracted position and for releasing said handle in response to receiving a coin.

21. The newspaper dispenser of claim 19 wherein said actuating means further comprises spring means in mechanical communication with said transverse bar for exerting a force thereon and a direction for moving said transverse bar towards the retracted position.

22. The newspaper dispenser of claim 21 wherein said actuating means further comprises hydraulic means for yieldably resisting the motion of said transverse bar towards the retracted position.

23. The newspaper dispenser of claim 11 further comprising a following roller mounted on said mounting means in a spaced apart relationship with the transverse bar for movement in unison with said transverse bar in a direction co-planar with the end newspaper, said following roller being operable to maintain said transverse bar spaced apart from the end newspaper at a predetermined spacing distance.

24. The newspaper dispenser of claim 22 further comprising:

a middle pressure bar having one end mounted adjacent the rear of said housing and extending along the midregion of the end newspaper between said transverse bar and the end newspaper, said middle pressure bar being oriented parallel to the direction of travel of said transverse bar; and middle spring means for securing the other end of said middle pressure bar adjacent the front of said housing, said middle spring means being operable to resiliently force said middle pressure bar against the end newspaper to apply an evenly distributed pressure along the midregion thereof.

25. The newspaper dispenser of claim 11 further comprising:

an axle;

a pair of roller rotatably mounted in a spaced apart relationship on said axle;

a coil spring mounted on said axle between said rollers and being operable to exert outward forces on each of said roller; and support structure fixedly attached adjacent the end of said axle for mounting said axle on said mounting means and for retaining said rollers on said axle.

26. The newspaper dispenser of claim 11 further comprising:

a paper tray for supporting a stack of newspapers within said housing;

tray springs for forcing said paper tray and stack of newspapers towards said transverse bar; and a front roller disposed adjacent said passage means for engaging the stack of newspapers and resisting the force of said tray springs to align the end newspaper of the stack with said passage means.

27. The newspaper dispenser of claim 26 further comprising:

a winch;

a nylon rope wound on said winch; and guide means for interconnecting and guiding the nylon rope between said winch, the bottom of said housing, and said paper tray, so that said winch may be used to tension said nylon rope to pull said paper tray away from said transverse bar to enhance loading of newspapers onto the paper tray.

28. The newspaper dispenser of claim 26 further comprising:

a winch;

cable means wound on said winch;

guide means for guiding and interconnecting said cable between said winch, the bottom of said housing, and said paper tray;

a head extending from said winch for rotating said winch;

a detachable crank having a socket on one end thereof for mating with said head, said socket being detachably fitted on said head for cranking said winch to tension said cable and to pull said tray in a direction away from said transverse bar.

29. The newspaper dispenser of claim 11 wherein said mounting means comprises:

a carriage;

means for rotatably mounting said transverse bar on said carriage;

a pair of tracks extending in a parallel spaced apart relationship with the end newspaper of the stack of newspapers; and wheels mounted on each end of said carriage for rolling in said tracks to transport said transverse bar between the retracted position and the dispensing position.

30. The newspaper dispenser of claim 29 further comprising:

a center guide rod oriented in a position parallel with the linear motion of said carriage and generally perpendicular to said transverse bar;

a slideway formed in said carriage for receiving and sliding on said center guide rod; and said center guide rod being operable to maintain said carriage in a position centered between said tracks as said carriage moves said transverse bar between the retracted position and the dispensing position.

31. The newspaper dispenser of claim 11 wherein said mounting means comprises:

a carriage;

means for rotatably mounting said transverse bar on said carriage;

a pair of upper tracks extending in a parallel spaced apart relationship with the end newspaper of the stack of newspapers;

a pair of lower tracks extending in an adjacent parallel spaced apart relationship with said pair of upper tracks, said end newspaper being disposed below said lower tracks;

two pairs of upper wheels, one pair of said upper wheels being mounted on each end of said carriage, for rolling on the lower surfaces of the upper tracks;

two lower wheels, one of said lower wheels being mounted on each end of said carriage, for rolling on the upper surfaces of said lower tracks; and said upper and lower wheels being operable to transport said carriage along said upper and lower tracks for moving said transverse bar between the retracted position and the dispensing position.

32. The newspaper dispenser of claim 31 further comprising at least one retaining flange extending along each of said upper and lower tracks to retain said wheels on said tracks.

33. The newspaper dispenser of claim 31 further comprising:

lower retaining flanges extending along the inside edges of said lower tracks to retain said lower wheels thereon; and upper retaining flanges extending along the outside edges of said upper tracks to retain said upper wheels thereon.

34. The newspaper dispenser of claim 10 further comprising a middle pressure bar extending along the midregion of the end newspaper between said transverse bar and the end newspaper for applying pressure along the midregion of the end newspaper, said middle pressure bar being oriented parallel to the direction of travel of said transverse bar.

35. The newspaper dispenser for dispensing an end newspaper from one end of a stack of newspapers, comprising:

a housing containing the stack of newspapers;

a transverse bar disposed within said housing adjacent to the end newspaper of the stack of newspapers;

a carriage;

means for rotatably mounting said transverse bar on said carriage for rotation about the center axis of said transverse bar;

a pair of upper tracks extending in a parallel spaced apart relationship with said end newspaper;

a pair of lower tracks extending in an adjacent, parallel, spaced apart relationship with said pair of upper tracks, the end newspaper being disposed below said lower tracks;

two pairs of upper wheels, one pair of said upper wheels being mounted on each end of said carrage, for rolling on the lower surfaces of the upper tracks;

two lower wheels, one of said lower wheels being mounted on each end of said carriage, for rolling on the upper surfaces of said lower tracks;

said upper and lower wheels being operable to transport said carriage along said upper and lower tracks for moving the transverse bar in a linear motion parallel with the plane of the end newspaper, said transverse bar being movable through said linear motion between a retracted position and a dispensing position;

actuating means for moving said transverse bar between the retracted position and the dispensing position;

at least two pins mounted on said transverse and being movable by rotation of said transverse bar between an engagement position and a disengagement position, said pins being positioned to engage and pierce the end newspaper of the stack of newspapers when in the engagement position and to disengage the end newspaper when in the disengagement position;

a cocking lever fixedly mounted on said transverse bar and extending outwardly therefrom;

a cocking stop positioned to selectively engage the cocking lever during the linear motion of said transverse bar;

said cocking lever engaging said cocking stop as said transverse bar moves from the dispensing position toward the retracted position to cock said cocking lever and rotate said transverse bar to force said pins into the engagement position when said transverse bar is moved to the retracted position;

said pins being operable to slidably propel the end newspaper in a linear direction along the end of the stack of newspapers when said transverse bar is moved by said actuating means from the retracted position to the dispensing position; and passage means formed in said housing for receiving and transmitting the end newspaper from within said housing to without said housing when said transverse bar is moved by said actuating means from the retracted position to the dispensing position.

* * * * *